United States Patent [19]

Coleman et al.

[11] 4,424,754

[45] Jan. 10, 1984

[54] BURNER CONTROL

[75] Inventors: Colin R. Coleman, Kingston-upon-Thames; Joseph L. King, Renfrewshire, both of Great Britain; William J. Bridges, Glasgow, Scotland

[73] Assignee: Babcock Power Limited, London, England

[21] Appl. No.: 392,696

[22] Filed: Jun. 28, 1982

[30] Foreign Application Priority Data

Jul. 1, 1981 [GB] United Kingdom ..... 8120335
Aug. 21, 1981 [GB] United Kingdom ..... 8125677

[51] Int. Cl.[3] ..... F23N 5/02
[52] U.S. Cl. ..... 110/190; 110/185; 110/263; 110/347; 431/25
[58] Field of Search ..... 110/263, 264, 347, 185, 110/190; 431/79, 25

[56] References Cited

U.S. PATENT DOCUMENTS

| | | | |
|---|---|---|---|
| 3,836,316 | 9/1974 | Ikegami et al. | 431/79 |
| 3,902,841 | 9/1975 | Horn | 431/79 |
| 3,988,104 | 10/1976 | Barber | 431/79 X |
| 4,039,844 | 8/1977 | McDonald | 431/79 X |

*Primary Examiner*—Edward G. Favors
*Attorney, Agent, or Firm*—Kemon & Estabrook

[57] ABSTRACT

The invention is concerned to control the combustion conditions of a burner 1 supplied with a mixture of pulverized fuel and air. By use of a vortex amplifier 10 in the supply pipe 3, the supply of fuel is interrupted so that the flame is consequently first too lean and then too rich. The temperature of the burner flame is monitored by a photodiode device 6a and an indication is produced of the delay between the operation of the vortex amplifier 10 and the flame temperature passing through that indicating that the flame conditions are optimum. The length of the delay will indicate whether, and to what extent, the flame before the operation of the vortex amplifier was too lean or too rich. Adjacent burners can be controlled by operating the vortex amplifiers associated with each at different regular frequencies.

9 Claims, 2 Drawing Figures

BURNER CONTROL

DESCRIPTION

Figure 1:
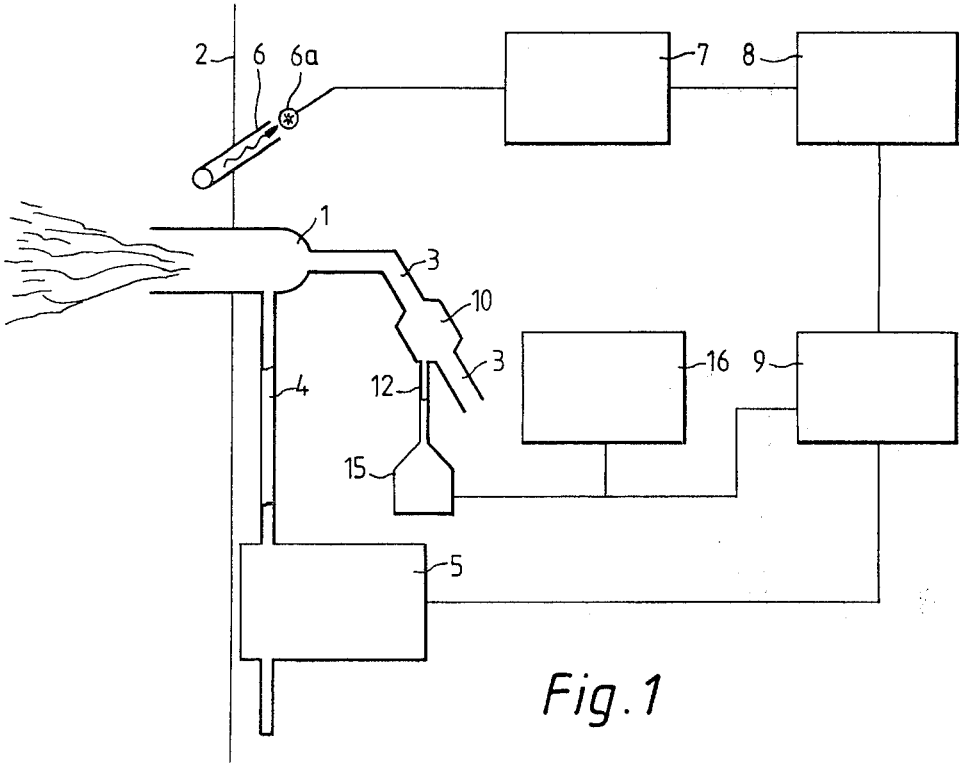

For any given rate of supply of fuel, the temperature of the flame in a furnace from a burner that is operating with the combustion of pulverised fuel in air will theoretically be a maximum at stoichiometry. An excess of air or an excess of fuel in the combustion zone will result in a temperature lower than that. To achieve stoichiometry in the flame as nearly as possible is desirable for the sake of the most efficient utilization of the fuel. Beside that, if the flame is rich (in that too much fuel is supplied) unburnt fuel may result in corrosion on the furnace walls whilst if the flame is lean (in that too much air is supplied), the oxidising conditions may result in the formation of noxious gases such as nitrogen dioxide and sulphur trioxide.

It is possible and desirable to monitor the flame temperature—by a light sensitive device, such as a photodiode device, for instance—and whilst this will indicate a departure from optimum combustion conditions, it will not tell whether the departure results from an excess of air or an excess of fuel. An object of the invention is to facilitate the use of a device responsive to the temperature of the flame from a burner in such a way as to indicate whether the flame is deficient in fuel or in air.

According to the present invention, there is provided means for use in controlling the operation of a burner that is supplied with a mixture of pulverised fuel and air, comprising means responsive to the flame temperature and arranged to provide a signal of which a value is dependent upon the flame temperature, means to indicate when the value corresponds to a predetermined flame temperature, means whereby the flow of fuel to the burner may be disturbed from a current rate so that its rate is first above or below the current rate and then below or above the current rate with the result that the value passes through a predetermined value corresponding to the predetermined flame temperature, and means by which the rate at which air or fuel is supplied to the burner may be altered according to whether or not the predetermined value is reached before or after a predetermined time after the disturbance has been instigated in the sense that would tend to reduce the interval between the predetermined value being reached and the predetermined time after the disturbance has been instigated.

According to the invention, there is also provided a method of controlling the operation of a burner that is supplied with a mixture of pulverized fuel and air comprising producing a signal of which a value is dependent upon the flame temperature, producing an indication when the value corresponds to a predetermined flame temperature, and disturbing the flow of fuel to the burner from a current rate so that its rate is first above or below the current rate and then below or above the current rate with the result that the value passes through, as a result of the disturbance, the predetermined value corresponding to the predetermined flame temperature, and altering the rate at which air or fuel is supplied to the burner according to whether or not the predetermined value is reached before or after a predetermined time after the disturbance has been instigated, the alteration being in the sense that would tend to reduce the interval between the predetermined value being passed and the predetermined time after the disturbance has been instigated.

Figure 2:
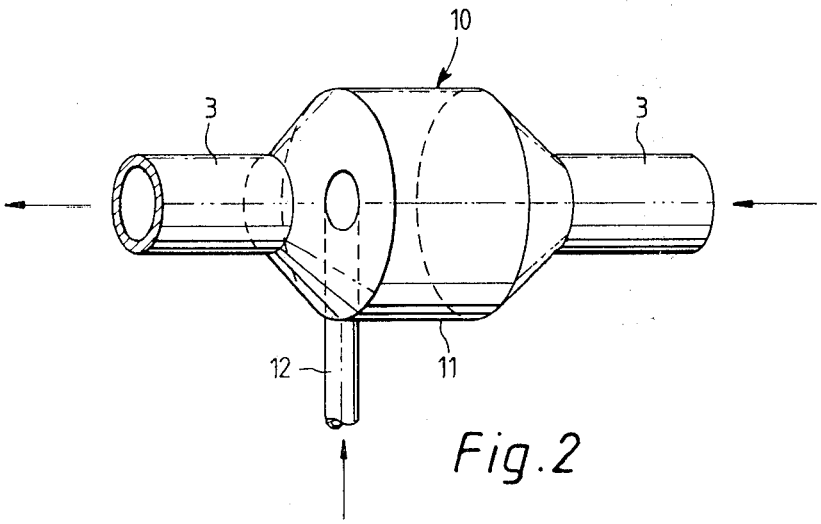

By way of example, an embodiment of the invention will now be described with reference to the accompanying somewhat diagramatic drawings in which:

FIG. 1 indicates a pulverized fuel burner and associated control equipment, and FIG. 2 illustrates a vortex amplifier included in a duct through which the burner is supplied with pulverized fuel.

The burner 1 is mounted in the wall 2 of a furnace and is one of a plurality of similar burners (not shown) by which the furnace is fired. A mixture of pulverized fuel and primary air is supplied to the burner 1 through the pipe 3 and secondary air is supplied through the duct 4, the rate of flow of secondary air being controlled by the trimming device 5.

The wall 2 of the furnace is also penetrated by means 6 defining a light path along which the photodiode device **6*a* may "look at" the flame of the burner 1. An effect of the means 6 is that the photodiode device 6*a* is largely unaffected by changes in the temperatures of the flames from the other burners. The device 6*a* is arranged to produce a signal that is dependent upon flame temperature in response to the colour of the flame. The signal from the photodiode device 6*a* is passed through a tuned amplifier 7 and detector circuit 8 to phase comparator 9**.

The pipe 3 includes a vortex amplifier 10 by which controlled variations in the rate of flow of fuel through the pipe 3 can be effected. The amplifier 10 includes a drum 11 concentric with the pipe 3 and, in effect, forming a local enlargement of the pipe 3. A duct 12 opens tangentially into the drum 11. By discharging a blast of air into the drum 11 through the duct 12, the flow of fuel to the burner will be momentarily slowed down, with the result that the supply of fuel to the burner is first reduced below the current value but the fuel that is delayed will then flow to the furnace so that the rate of flow of momentarily increased above the current value.

The duct 12 leads to the vortex amplifier 10 from a source 15 that is controlled by a pulse generator 16. The generator 16 is such as to generate pulses at a regular frequency of, say one every half, or one, or two seconds, and each of which is fed to the phase comparator 9 and simultaneously to the source 15. On receipt of a pulse at the source 15, a solenoid valve is activated to release from the source 15 a blast of air to the vortex amplifier 10. The effect of the blast is such as to ensure that, provided the flame is not initially excessively lean or excessively rich, the flame will become lean and then rich, passing through optimum combustion conditions in between. The signal from the photodiode device **6*a* will follow the effect on the flame of these changes and be a maximum when the flame conditions pass through optimum. The delay at the phase comparator 9 between the initiating pulse and the consequent signal indicating that the flame has passed through optimum conditions will represent the condition of the flame prior to the generation of the pulse. The longer the delay, the leaner were the original conditions. The phase comparator 9 is connected to the trimming device 5** and adjusts the supply of secondary air automatically in the sense that tends to maintain the delay at the value that would result from the original conditions being optimum.

It will be realised that by supplying blasts of air to the vortex amplifier at a regular frequency, the consequent changes in flame temperatures will occur at a dependent frequency, being double that of the supply of blasts of air. The tuned amplifier is therefore adjusted to accept signal changes that derive from the blasts of air to the vortex amplifier and not other signals. Thus, when two or more burners are adjacent each other, the frequencies of the supply of blasts of air to the vortex amplifiers associated with the burners may be set to be different, and the tuned amplifier associated with any one burner may be adjusted not to respond to signals if the frequency that derive from any of the other adjacent burners.

In use of the apparatus that has been described, the flow of fuel to the burner is interrupted regularly but more intermittent operation is envisaged.

The vortex amplifier that has been described makes efficient use of the air that is supplied in blasts to upset the flow to the burner that alternatives are envisaged. For instance, the enlargement shown in the drawings may not be provided, and the disturbing blasts of air be discharged tangentially into a fuel pipe of constaant diameter or of which the diameter at the point of introduction of the disturbing air is reduced. It is also envisaged that, whatever the diameter into which the disturbing blasts of air are introduced, that air may be directed across the pipe so that a vortex by which the flow of fuel is disturbed results from reflection from the opposite wall of the pipe. It is also envisaged, where the fuel flows along a pipe of which the direction changes in the vicinity of the burner and a strike plate is provided at the band, that the disturbing air may be introduced through a tube extending through the strike plate and parallel to the axis of the downstream part of the pipe. Discharge from the tube may be circumferentially within, or across, the pipe.

In general, it is desirable that the disturbance to the flow of fuel through the pipe 3 should be created close to the outlet from the pipe, although it may be displaced upstream and associated with some other functional component in the fuel supply path.

The effect of the vortex amplifier that has been described is first to make the flame too lean and then too rich. It is envisaged that alternative devices could be used by which the flame is first made too rich and then too lean.

The invention is likely to find especial value in connection with furnaces that have several burners connected through a splitter to a common source, since the splitter may not be effective to divide consistently the fuel reaching it, and use of the invention will facilitate efficient combustion despite the vagaries of the splitter.

It will be realized that what has been described depends upon the detection of the peak of the flame temperature, and not the value of the peak, so that the photodiode device may get somewhat dirty without impeding the effectiveness of the apparatus.

We claim:

1. Means for use in controlling the operation of a burner that is supplied with a mixture of pulverized fuel and air, comprising means responsive to the flame temperature and arranged to produce a signal of which a value is dependent upon the flame temperature, means to indicate when the value corresponds to a predetermined flame temperature, means whereby the flow of fuel to the burner may be disturbed from a current rate so that its rate is first above or below the current rate and then below or above the current rate with the result that the value passes through a predetermined value corresponding to the predetermined flame temperature, and means by which the rate at which air or fuel is supplied to the burner may be altered according to whether or not the predetermined value is reached before or after a predetermined time after the disturbance has been instigated in the sense that would tend to reduce the interval between the predetermined value being reached and the predetermined time after the disturbance has been instigated.

2. Means as claimed in claim 1 in which the means whereby the flow of fuel to the burner may be disturbed is such as to disturb the flow automatically at regular intervals.

3. Means as claimed in either claims 1 or 2 comprising a pipe through which pulverized fuel entrained in air can be supplied to the burner and the means whereby the flow of fuel to the burner may be disturbed includes means whereby a blast of air may discharged into the pipe laterally of the direction of flow of fuel through the pipe.

4. Means as claimed in claim 3 in which the means whereby a blast of air may be discharged is such that the air is discharged tangentially into the pipe and the diameter of the pipe in the region of the discharge is larger than that of the pipe upstream and downstream of that region.

5. Means as claimed in claims 1 or 2 in which the burner is connected to a source of auxiliary air, and means is provided to vary the supply of auxiliary air in the sense that would tend to reduce the interval.

6. Means as claimed in claims 1 or 2 in which the means responsive to the flame temperature is a photodiode device.

7. A method of controlling the operation of a burner that is supplied with a mixture of pulverised fuel and air comprising producing a signal of which a value is dependent upon the flame temperature, producing an indication when the value corresponds to a predetermined flame temperature, and disturbing the flow of fuel to the burner from a current rate so that its rate is first above or below the current rate and then below or above the curent rate with the result that the value passes through, as a result of the disturbance a predetermined value corresponding to the predetermined flame temperature, and altering the rate at which air or fuel is supplied to the burner according to whether or not the predetermined value is reached before or after a predetermined time after the disturbance has been instigated, the alteration being in the sense that would tend to reduce the interval between the predetermined value being passed and the predetermined time after the disturbance has been instigated.

8. A method as claimed in claim 7 in which the flow of fuel to the burner is disturbed at regular intervals.

9. A method as claimed in claim 8 by which the operation of an adjacent burner is controlled, the regular intervals at which the flows of fuel to the burners is disturbed being different.

* * * * *